United States Patent [19]

Kato et al.

[11] 4,354,726

[45] Oct. 19, 1982

[54] BATTERY TERMINAL CONNECTOR WITH AN UNEVEN INTERIOR SURFACE

[75] Inventors: Shinichi Kato, Fujisawa; Syuichi Otani, Tokyo; Susumu Hashimoto, Kitakawabe, all of Japan

[73] Assignee: Nissan Motor Company, Limited, Yokahama, Japan

[21] Appl. No.: 131,093

[22] Filed: Mar. 18, 1980

[30] Foreign Application Priority Data

Mar. 20, 1979 [JP] Japan ..... 54-36094[U]
Mar. 20, 1979 [JP] Japan ..... 54-36097[U]

[51] Int. Cl.[3] ..... H01R 11/26
[52] U.S. Cl. ..... 339/230 R
[58] Field of Search ..... 339/224–240

[56] References Cited

U.S. PATENT DOCUMENTS

| | | | |
|---|---|---|---|
| 1,759,043 | 5/1930 | Derby | 339/230 R |
| 1,916,728 | 7/1933 | Hill | 339/230 R |
| 2,222,577 | 11/1940 | Thompson | 339/230 R |
| 3,980,387 | 9/1976 | Neidecker | 339/228 |
| 4,063,794 | 12/1977 | Dittmann | 339/230 R |

FOREIGN PATENT DOCUMENTS

| | | | |
|---|---|---|---|
| 1486788 | 5/1967 | France | 339/231 |
| 1181179 | 2/1970 | United Kingdom | 339/231 |

*Primary Examiner*—Joseph H. McGlynn
*Attorney, Agent, or Firm*—Schwartz, Jeffery, Schwaab, Mack, Blumenthal & Koch

[57] ABSTRACT

A connector for connecting a battery terminal to an electrical cable of an automotive vehicle, comprising: a gripping portion formed of elastically deformable material in the shape of a cylindrical or part-conical shell which has a slot formed axially thereof; two extensions from this gripping portion, each extending outwardly from one side of the slot, and extending generally in the same direction, approximately parallel to one another, and to one of which the cable is coupled; and a means for biasing these two extensions towards one another; with the particular feature that the inner surface of the gripping portion is formed with a plurality of high portions and low portions on it, so that, when it is brought around a battery terminal post and closely contacted thereto by the extensions being biased towards one another by the biasing means and deforming the gripping portion so that its inner surface is constricted, the contact area between the gripping portion and the battery terminal is substantially less than the total area of the inner surface of the gripping portion, and is interrupted by non-contacting portions of the said area. In particular embodiments, this inner surface of the gripping portion can be formed with troughs or with raised ribs, and these can either be axial along the inner surface, or can extend around its circumferential direction. Alternatively, this inner surface can be formed with either a raised or a depressed criss-cross diagonal pattern thereon. Further, a projection from one of the extensions may be provided as projecting towards the other extension, in order to prevent these extensions approaching one another closer than a certain fixed distance.

12 Claims, 9 Drawing Figures

BATTERY TERMINAL CONNECTOR WITH AN UNEVEN INTERIOR SURFACE

BACKGROUND OF THE INVENTION

1. Field of the Invention

The present invention relates to the battery terminal connecting devices which connect a battery mounted on an automotive vehicle to electrical equipment or accessories mounted on the vehicle which are operated by electric power supplied from the battery, or which provide electric power to the battery. More particularly, the present invention relates to an improvement in and relating to a battery terminal connecting device, which is attached to the end of one or a plurality of leads which connect the battery to vehicle equipment and/or accessories, and which is releasably attached to a battery terminal post.

2. Description of the Prior Art

It is conventional to equip an automotive vehicle with one or more storage batteries, with battery terminal posts, for accumulating electricity and for supplying electric power to various equipment and accessories provided on the vehicle, such as, for example, an electric self starter for the engine, vehicle running lights such as head lamps, a broadcast radio receiver, an alternator which supplies electric power to the battery, and so on. Cables from these various units are provided as brought together into a main cable, and it is well known in the art to provide on the end of this main cable a battery terminal connection device, which is a connector engageable to the battery terminal post.

For mounting and dismounting of the battery to and from the automotive vehicle, and for replacement of the battery, it is convenient for this battery terminal connecting device to be easily releasably attachable and detachable to the battery terminal post. Further, although usually most of the electrical appliances of the vehicle are supplied from one main cable which is attached to the battery terminal connecting device, it is known in the art for an auxiliary terminal to be arranged on the battery terminal connecting device for an auxiliary electrical cable to be attached detachably thereto by a clip. This construction is often provided so that appliances or equipment connected to said cable may be quickly and easily disconnected from the source of electrical power, i.e. the battery, without the necessity for releasing the battery terminal connecting device from the battery terminal post, which may require special tools, and take a lengthy time in an emergency, for example.

In the prior art, there have been provided various different constructions for the battery terminal connecting device, and for the battery terminal post. It has been practiced to provide the battery terminal post as a flattened lug with a hole therein, through which a nut and bolt are engaged so as to attach a lug with a hole therein, this lug serving as the battery terminal connecting device. However, most modern batteries are provided with battery terminal posts which are cylindrical or are frusta of narrow angled cones. Various constructions of battery terminal connecting device for such battery terminal posts have been proposed.

A typical such construction for such a battery terminal connecting device comprises a connecting portion of a generally cylindrical or slightly conical shape, which is wrapped around the battery terminal post, so as nearly completely to surround it, and is made of an elastically deformable and electrically conducting material, with a pair of extensions, extending from the ends of the wrapped around connecting portion, which are each formed with an aperture. A bolt and nut clamping means is passed through these apertures, and thereby, by tightening the bolt and nut means, the size of the wrapped around connecting portion may be reduced, so that it may exert force on the battery terminal post and clamp on it securely. On the other hand, when it is desired to remove the battery terminal connecting device from the battery terminal post, by loosening the bolt and nut means the size of the cylindrical connecting portion of the connector may be increased, so that it becomes loose on the battery terminal post, and may be easily removed therefrom. Further, the main electrical connecting cable is usually attached to the end of one of the extensions remote from the battery terminal connecting post.

In the case of lead acid storage batteries of the usual sort, which include, typically, highly active chemical substances, it is a frequent occurrence that deposits of various corrosive chemicals, such as sulphates, etc., become gradually, over a period of time, deposited on the terminal and around the battery terminal connecting device. Both for reasons of appearance and cleanliness, and because these deposits tend to reduce the quality of the electrical connection between the battery terminal connecting device and the battery terminal post, it is preferable frequently to remove the battery terminal connecting device from the battery terminal post in order to clean both of them. It is also necessary to remove the battery terminal connecting device from the battery terminal post in order to service or to change the battery. On the other hand, because of vibrations caused while the automotive vehicle is running, and other shocks, there is a requirement that the battery terminal connecting device should be securely and tightly clamped onto the battery terminal post during operation of the automotive vehicle, in order to prevent the possibility that the battery terminal connecting device should accidentally be released from its electrical connection from the battery terminal post, thus interrupting the supply of electrical power to the accessories and appliances of the vehicle. Therefore, in the above described prior art, it is necessary to clamp up the bolt and nut means very tightly, and, accordingly, to elastically deform to a considerable extent the portions of the extensions extending out from the cylindrical connecting portion of the battery terminal connecting device to their apertures through which the bolt and nut means passes, so as to exert considerable force on the battery terminal post. Since it is necessary, as above explained, frequently to remove and replace the battery terminal connecting device from the battery terminal post, this repeated elastic deformation of the connecting portion of the battery terminal connecting device and of the extensions may result in permanent plastic deformation thereof, and over a long period of time this plastic deformation proceeds to such an extent that the battery terminal connecting device will no longer grip the battery terminal post properly, even when the bolt and nut means is screwed up very tightly. Thereby, electrical connection between the battery terminal connecting device and the battery terminal post becomes unreliable, and interruption of electric power supply to the accessories and equipment of the vehicle may occur.

Thus, the battery terminal connecting device becomes unsuitable for further service.

The difficulty is that, since the internal surface of the cylindrical or part-conical connecting portion of the conventional battery terminal connecting device is smooth, and closely touches the battery terminal post almost all around its circumference, the contacting area therebetween is relatively large, and therefore, in order to provide a given required contact force per unit area between the surface of the contact terminal connecting device and the battery terminal post, sufficient for good electrical contact therebetween, a considerable total force must be provided by the bolt and nut means. This force inevitably causes damage over a long period of service to the battery terminal connecting device. If the contact clamping force per unit contact area between the connecting portion of the connector and the battery terminal post is not sufficient, since the internal surface of the connecting portion is smooth, as is also the battery terminal post, there is a danger that the battery terminal connecting device may easily turn on the battery terminal post. Such turning leads very quickly to electrical disconnection between the battery terminal connecting device and the battery terminal post, and even to physical disconnection, which can lead to an electrical accident, and even fire.

In order to restrict the production of the above described sulphates and chemical deposits on and around the battery terminal post, and also to promote easy removability of the battery terminal connecting device from the battery terminal post, when it is desired so to remove it, it has been commonly practiced to apply a lubricant such as petroleum jelly or other well known lubricants between the battery terminal connecting device and the battery terminal post, when connecting them. However, with the conventional designs of battery terminal connecting device as described above, almost all of such lubricant is inevitably squeezed out from between the battery terminal connecting device and the battery terminal post, as soon as the clamping means, such as a nut and bolt, is tightened up, because their cooperating surfaces are smooth and mate snugly. Such lubricant therefore tends to have little long term effect.

A second type of prior art battery terminal connecting device is one wherein the contacting area between the connecting portion of the battery terminal connecting device and the battery terminal post is not a simple cylinder or frustum of a cone, but is rather two separate cylindrical rings. Each of these rings has extensions, and the two extensions on each side are joined together by a cross piece with a hole bored therethrough, clamping means being passed through these holes, as before. Effectively, this kind of battery terminal connecting device is equivalent to two thin ones of the normal conventional sort of battery terminal connecting device described above, installed one above the other, and the problem still remains that, because, taking each of the rings individually, the cross-sectional area of the part of the ring's extension which transmits force from the clamping means to the part of the ring which contacts the battery terminal post bears a similar relationship as in the above described prior art to the contacting area between the ring and the battery terminal post, there still remains the problem of deformation of this part of the extensions, if sufficient pressure is to be brought to bear between the battery terminal connecting device and the battery terminal post, per square unit of contact area, to establish good electrical contact therebetween.

SUMMARY OF THE INVENTION

The present invention takes as its point of departure the observation that, if it were possible to reduce the area of contact between the connecting portion of the battery terminal connecting device and the battery terminal post, then less force would be required, in total, to clamp these two elements together, in order to provide a required minimum contact pressure per unit of area in order to ensure good electrical contact therebetween.

Therefore, it is an object of the present invention to provide an improved battery terminal connecting device for providing electrical connection of a cable to a battery terminal post, which has a cylindrical or part-conical connecting portion of a modified sort, capable of making good electrical contact with the battery terminal post, while at the same time not requiring unduly large force to provide such contact.

It is a further object of the present invention to provide an improved and longer lasting battery terminal connecting device whose connecting portion grips more tightly and positively the battery terminal post than has been the case of the prior art.

It is a further and particular object of the present invention to provide such an improved battery terminal connecting device which is provided with a means for restricting undue tightening together of the two extensions which extend from the cylindrical portion, by means of compression resistance, which desirably cooperates with the connecting portion which grips the battery terminal post, so as to ensure steady, firm, and yet not excessive pressure and squeezing of the connecting portion onto the battery terminal post.

Thereby, according to the present invention, there is provided an improved battery terminal connecting device, whereby good electrical contact between the battery terminal post and the battery terminal connecting device is maintained, while no portion of the battery terminal connecting device is sufficiently deformed by tightening of the bolt and nut means incorporated therein as to undergo long term damage, while at the same time tight and reliable physical connection between the battery terminal connecting device and the battery terminal post is ensured, so that the battery terminal connecting device is extremely unlikely to become loose on the battery terminal post, or to become accidentally detached therefrom, and further while it is ensured that the battery terminal post is not subjected to undue compression forces on a restricted part of its circumference, such as to damage the surface thereof.

By such a construction of a battery terminal connecting device as outlined above, it is ensured that the force which is exerted by the clamping means and is transmitted by the inner parts of the extensions, so as to clamp the cylindrical contacting portion around the battery terminal post, is concentrated in a restricted area of contact between the contacting portion of the battery terminal connecting device and the surface of the battery terminal post, whereby the overall applied force per unit of area between these two surfaces is much greater than in the conventional prior art designs described above, because in all of those the ratio between the cross-section of the part of the extensions between the clamping means and the connecting portion of the battery terminal connecting device to the area of contact between the connecting portion of the battery terminal connecting device and the battery terminal post is substantially fixed by the design. However, with the present design as outlined above, extensions of the same strength as in the prior art, and therefore capable of reliably transmitting the same force, are enabled to exert this force on a substantially smaller contact area, and thus to produce greater overall pressure per unit area, and thereby to promote better and more reliable electrical contact and physical connection between the battery terminal connecting device and the battery terminal post.

Thereby, the battery terminal connecting device according to the present invention improves on the above outlined disadvantages and defects which are present in prior art battery terminal connecting devices, and can reliably and durably fulfil its function of receiving electric power from and distributing electric power to the various accessories and equipment of an automotive vehicle.

Additionally advantages of the battery terminal connecting device according to the present invention are as follows. First, because of the fact that the contact surface between the battery terminal connecting device and the battery terminal post is not one uninterrupted area, but is broken up by a multitude of non-contacting areas, deposits such as sulphates and other chemical accumulations, which inevitably, as described above, will accumulate on the surface of the battery terminal post, and between it and the battery terminal connecting device, may become concentrated in these non-contact areas, and thus are far less likely by their swelling and levering effect to interrupt electrical connection between the battery terminal connecting device and the battery terminal post. Secondly, such non-contact areas interrupting the overall contact area between the battery terminal connecting device and the battery terminal post, provide useful recesses for the storage of petroleum jelly or other lubricant which may be applied when the battery terminal connecting device is secured to the battery terminal post, as described above. By these reservoirs, effective supply of this petroleum jelly or other lubricant may be maintained for a much longer time. Thirdly, by the irregularity of the contact surface between the battery terminal connecting device and the battery terminal post, twisting of the battery terminal connecting device on the battery terminal post is made substantially more difficult, and thereby accidental electrical or physical disconnection of the battery terminal connecting device from the battery terminal post is made far less likely. Thereby, as a whole, the battery terminal connecting device, according to the present invention, can provide a much improved overall performance of connection of electrical accessories and appliances of an automotive vehicle to the terminal of a battery.

The other objects and advantages of the present invention will become more apparent from the hereinafter described embodiments.

BRIEF DESCRIPTION OF THE DRAWINGS

The present invention will become more fully understood from the following description of some preferred embodiments thereof, which is to be taken in conjunction with the accompanying drawings. It should be clearly understood, however, that the description of the embodiments, and the drawings, are all of them provided purely for the purposes of illustration and exemplification only, and are in no way to be taken as limitative of the scope of the present invention. In the drawings.

DETAILED DESCRIPTION OF THE PRIOR ART

Figure 1:
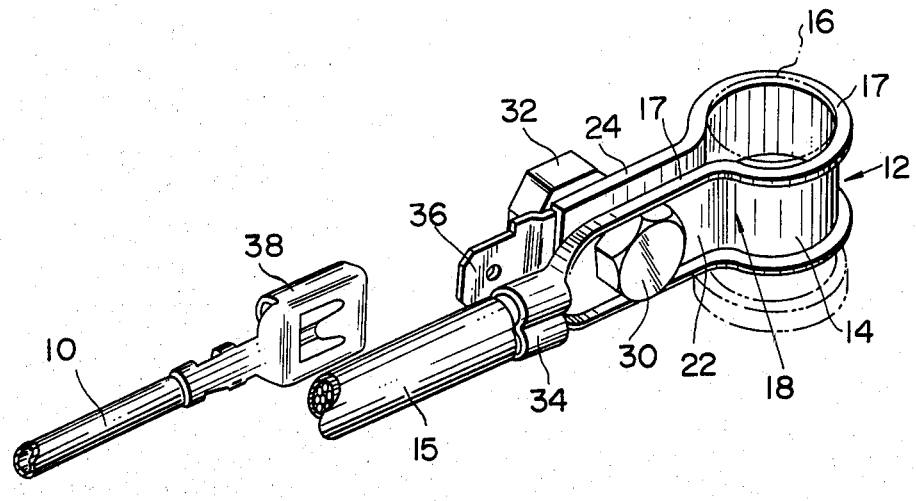
FIG. 1 (PRIOR ART)
FIG. 1 is a perspective view of a conventional prior art battery terminal connecting device, shown as engaged over a battery terminal post which is outlined in phantom lines, and which is illustrated as connected to a main cable and an auxiliary cable and clip.
Figure 2:
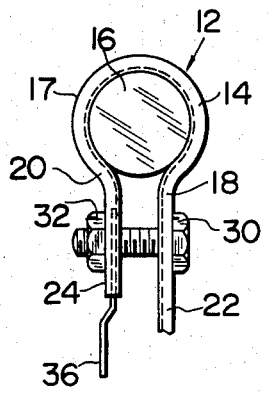
FIG. 2 (PRIOR ART)
FIG. 2 is a plan view of the prior art battery terminal connecting device shown in FIG. 1, in a condition wherein it is loosely attached around the battery terminal post, but is not tightened around it.
Figure 3:
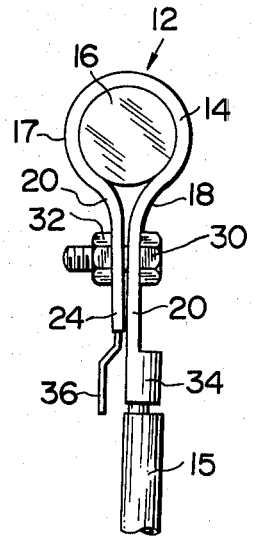
FIG. 3 (PRIOR ART)
FIG. 3 is a plan view of the battery terminal connecting device, and is similar to FIG. 2, except that it shows the battery terminal connecting device in a state wherein it is tightly engaged, by tightening of a bolt and nut means, so that it grips the battery terminal post tightly.

Before the description of the various preferred embodiments of the present invention, it will aid in understanding the concept thereof for the prior art described in general above to be more particularly explained, with reference to FIGS. 1–3 of the attached drawings.

The main power cable 15 extends from the various accessories and equipment of the automotive vehicle, to provide electrical connections between them and the battery terminal post. At the end of the main cable 15 there is attached a battery terminal connecting device of a prior art form, generally designated by 12. This battery terminal connecting device 12 comprises a generally cylindrical (or optionally shaped as a frustum of a narrow angled cone) connecting portion 14, which is formed with flanges 17 at its upper and lower sides, and two extensions 22 and 24, integrally formed therewith, which protrude outwards and are pierced with holes, not designated by any reference numerals, through which is passed a bolt 30 which is engaged with a nut 32. At the end of the extension 22 remote from the cylindrical connecting portion 14 there is clamped by crimping at 34 the main power cable 15, and on the end of the extension 24 which is remote from the cylindrical connecting portion 14 there is formed a clip pin 36, which is adapted to be engaged with a clip terminal 38 which is attached at the end of an auxiliary power cable 10 which leads to certain accessories or equipment of the automotive vehicle. The clip 38 is formed with an aperture so as to receive the pin 36. The battery terminal post is shown in FIG. 1 by phantom lines, and is designated by the reference numeral 16.

In FIGS. 2 and 3, the operation of attaching the battery terminal connecting device 12 to the battery terminal post 16 is explained. First, as is seen in FIG. 2, the battery terminal connecting device 12 is placed over the battery terminal post 16 loosely, with the nut 32 engaged near the free end of the bolt 30, so that the extensions 22 and 24 are some distance apart. Then the nut 32 is tightened on the bolt 30, whereby the extensions 24 and 22 are bought closely together until they touch, as seen in FIG. 3, and thereby the cylindrical connecting portion 14 is deformed and clamped around the battery terminal post 16. Further, as will be seen in the drawings, the portions 18 and 20 of the extensions 22 and 24 are at this time quite severely deformed, because they are transmitting the tightening force which is deforming the cylindrical connecting portion 14. Thus, the battery terminal connecting device 12 is tightly clamped onto the battery terminal post 16. However, the above described plastic deformation of the portions 18 and 20 and of the cylindrical connecting portion 14 inevitably means that, after repeated connection and disconnection of the battery terminal connecting device 12 to the battery terminal post 16, these parts eventually become plastically deformed, and thereby eventually tightening the bolt 30 and the nut 32 is ineffective for securing sufficient clamping force per unit area between the cylindrical connecting portion 14 and the battery terminal post 16, and, accordingly, good electrical connection between these parts can no longer be assured, and, as explained above, it may even occur that good physical connection between them fails, thereby resulting in accidental detaching of the battery terminal connecting device 12 from the battery terminal post 16, which could, perhaps, be disastrous.

The basic cause of this difficulty is that the connecting or contact surface where the battery terminal connecting device 12, or rather its connecting portion 14, contacts the battery terminal post 16, being smooth, is rather large in area, and thus requires a considerable clamping force to be transmitted through the portions 18 and 20 of the extensions 22 and 24 in order to provide a minimum required clamping force per unit area; and further is easily liable to sliding, or twisting, of the battery terminal connecting device 12 on the battery terminal post 16, because of the smoothness of their contacting surfaces.

DESCRIPTION OF THE PREFERRED EMBODIMENTS

Figure 4:
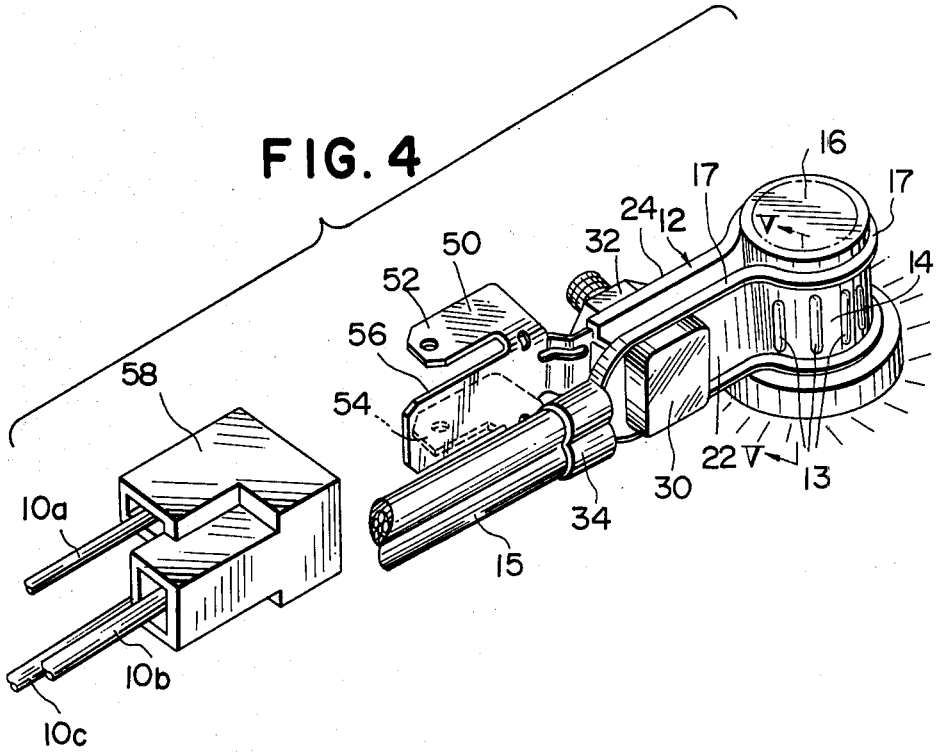
FIG. 4 is a perspective view, similar to FIG. 1, but showing a battery terminal connecting device which is a first embodiment of the present invention, and particularly showing the improved connecting portion of this connecting device.
Figure 5:
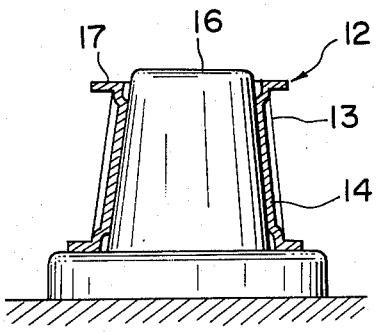
FIG. 5 is a cross-sectional view taken along the line V—V in FIG. 4 of the battery terminal connecting device and the battery terminal post, showing more particularly the improved connecting portion of the device.

We refer now to FIG. 4 of the accompanying drawings, which is a perspective view of a first embodiment of the present invention, and to FIG. 5, which is a sectional view through the battery terminal connecting device and the battery terminal post to which it is attached. The general construction of this battery terminal connecting device is similar to that shown in FIGS. 1, 2, and 3, and described under the section "Description of the Prior Art". Therefore, for simplification of explanation, and for better understanding of the invention, elements and structure of the embodiments of the present invention hereinafter shown which are substantially the same or similar to those of the above described conventional prior art battery terminal connecting device are designated by the same reference numerals, in the various illustrative figures, as were the parts of the prior art devices in FIGS. 1, 2, and 3.

As particularly shown in FIG. 4, the terminal connecting device, generally designated by 12, is connected to the cable 15 by the crimping portion 34 formed on the battery terminal connecting device 12. The battery terminal connecting device 12 further comprises a gripping portion 14, which, in this embodiment, is formed as a frustum of a narrow angled cone, i.e. a conical shell, arranged to co-act properly with the battery terminal post 16 to which the battery terminal connecting device 12 is to be attached. However, it is not essential that the battery terminal post 16 or the corresponding gripping portion 14 should be conical. They could be cylindrical. The gripping portion 14 is not entirely closed, a slot is formed extending axially of the gripping portion, so that it can open and shut slightly because of its own resilient characteristics. From each side of the slot protrudes an extension, and these extensions are designated as 22 and 24. They protrude generally in the same direction, outwards from the battery terminal post 16, almost in parallel. In the shown embodiment, the upper and lower edges of both the extensions 22 and 24 and also of the gripping portion 14 are provided with flanges extending generally perpendicular to them, for the purpose of reinforcement. However, this is not essential to the present invention. The extensions 22 and 24 are pierced with holes, not designated by any reference numerals, and through these holes, which oppose one another, there is passed a bolt 30 which has a nut 32 fitted thereon. Thus the bolt and nut 30 and 32 constitute a biasing means for squeezing and biasing together the two extensions 22 and 24. The connector of the present embodiment, as a matter of fact, is formed by bending and stamping one piece of generally planar electrically conductive material such as metal around a former.

At the end of the extension 22, there is provided a crimping portion 34 which is crimped tightly onto the electrical cable 15, which it is desired to attach electrically to the battery terminal 16. Further, at the end of the other extension 24, there is provided an auxiliary cable terminal, generally designated by the reference numeral 50, which is of a U-shaped cross-section, and which comprises upper and lower clip tags 52 and 54 (54 is shown by phantom lines in the drawing in FIG. 4 because it is not directly visible), and a intermediate clip tag 56; these clip tags being integrally formed from one piece of folded material. An auxiliary connector 58 is provided, and this auxiliary connector 58 has three clip terminals (which are not shown) so arranged within it that, when the terminal 58 is pushed over the clip tags 52, 54 and 56, these engage with the clip tags 52, 54, and 56: To each of these clip terminals in the auxiliary connector 58 is attached one of the leads 10*a*, 10*b* or 10*c*, which are auxiliary cables leading to various vehicle accessories or pieces of equipment which it is desired to have the capability quickly to detach from the battery terminal 16, should the need arise, without the necessity for undoing the bolt and nut 30 and 32. According to this construction, all these three cables may be quickly detached together by only one sudden jerk, in the case of emergency such as fire. Particularly, according to the present invention, on the inner surface of the connecting or gripping portion 14 there are impressed a plurality of high and low areas in the form of a number of troughs or indentations 13, extending axially aloy this inner surface, which in this embodiment are, in fact, formed by pressing, so that they correspond to ribs on the outer surface of the gripping portion. Thus, when the battery terminal connecting device 12 is placed over the battery terminal post 16, and the nut 32 is tightened on the bolt 30, the connecting or gripping portion 14 is tightened around the battery terminal post 16, and contacts it at the portions of its inner surface which are between the grooves 13. Because the area of these portions is substantially less than the total inner surface area of the gripping portion 14, the force of clamping is more concentrated on the contact portion, between the grooves 13, and thereby the total clamping force required from the bolt 30 and nut 32, and transmitted through the extensions 22 and 24, in order to provide a given minimum force per unit area on the contact surface between the gripping portion 14 and the battery terminal post 16, is reduced. Thereby, repeated fitting of the battery terminal connecting device 12 to the battery terminal post 16, and removing of it therefrom, is much less likely to result in fatigue and elastic deformation or failure of the extensions 22 and 24, or of the gripping portion 14. Further, even if some deformation occurs of the extensions 22 or 24, or of the gripping portion 14, because the clamping force provided by the bolt 30 and the nut 32 is concentrated on the parts of the inner surface of the gripping portion 14 in between the grooves 13, this clamping force, somewhat reduced by the deformation, may still probably be sufficient to ensure good electrical contact between the battery terminal connecting device 12 and the battery terminal post 16, and also good mechanical connection therebetween. Further, because of the irregularity provided by these grooves 13 on the inner contact portion portion of the gripping portion 14, it is much less likely that the battery terminal connecting device 12 should rotate around the battery terminal post 16, even in the case of incomplete tightening of the bolt 30 and nut 32, for example.

It is also to be noted, as a additionally advantage, that accumulations of sulphates or other chemicals produced by the battery during long operation may accumulate within these grooves 13, and therefore do not so easily as in the prior art have the tendency to lift up the inner surface of the gripping portion 14 from electrical and physical connection with the battery terminal post 16. Thereby the bad effects of these sulphate accumulations are greatly reduced.

Yet further, if petroleum jelly or other lubricant is used when fitting the battery terminal connecting device 12 to the battery terminal post 16, a reserve supply of this lubricant will become lodged in the grooves 13, and thereby will be available for some considerable time for lubricating the contact between these two elements, instead of being quickly squeezed out almost as soon as the bolt 30 and nut 32 are tightened, as in the above described prior art battery terminal connecting devices.

It will be understood, based upon the basic principle of the present invention, that, although the structure of the shown first embodiment provides the irregularities on the inner surface of the gripping portion 14 as depressed grooves which extend axially along this inner surface, this structure could be provided in other ways. What is important is that the inner surface of the connecting portion 14 should be so configured that its contact area with the battery terminal post 16 is substantially less than its total area, so as to concentrate the clamping force, and that this contact area should be interrupted by non-contact areas.

Figure 6:
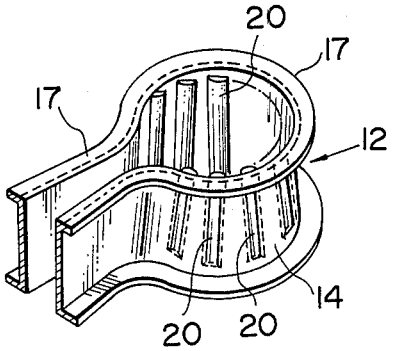
FIG. 6 is a perspective view, from an angle similar to FIGS. 1 and 4 of the connecting portion of a second embodiment of the battery terminal connecting device according to the present invention, shown in a partly cut away section.

Thus, a second possible embodiment of the present invention, which is shown in diagrammatical form in FIG. 6, which is a partly cut away perspective view of the connecting portion 14, provides raised ribs 20 on the inside of the connecting portion 14, instead of grooves 13. Again, these ribs 20 are shown as extending axially along the inside of the connecting portion 14. Thus, when this battery terminal connecting device 12 is clamped upon the battery terminal post 16, the raised tops of the ribs 20 provide concentrated clamping force on the battery terminal post 16, thus ensuring good electrical contact, and further preventing twisting of the battery terminal connecting device 12 on the battery terminal post 16. In this case the concentration of force is much greater than in the case of the first embodiment. Again, in this case, these ribs 20 are in fact formed by pressing, so that they correspond with grooves on the outside surface of the gripping portion 14.

It will be easily understood that the same subsidiary advantages, relating to the accommodation of accumulations of sulphates, etc., and to providing reservoirs for supply of lubricant such as petroleum jelly, are available in the structure of this second embodiment, as were available in the structure of the first embodiment.

Further, it will be easily understood that, although the first two embodiments have incorporated grooves or ribs extending axially along the inner surface of the gripping portion of the battery terminal connecting device, this is not essential, although perhaps it may be best for resisting twisting of the battery terminal connecting device on the battery terminal post; in fact, other configurations are possible. For example, it would be possible for either grooves or ribs to be formed on the inner surface of the gripping portion around its circumferential direction, and such a configuration, while it does not present extremely high resistance to twisting of the battery terminal connecting device on the battery terminal post, provides strong resistance against lifting off of the battery terminal connecting device from the battery terminal post, i.e. relative movement therebetween in the axial direction of the post Yet another possibility would be for either a raised or a depressed pattern of criss-cross diagonal lines, i.e. a lozenge pattern, to be formed on the inside surface of the gripping portion, angled to the axis thereof. This would provide a measure of resistance against movement of the connector with respect to the battery terminal post, both in the twisting mode, and in the axial mode. Different patterns on the inner surface of the gripping portion may be provided, as different embodiments, to suit different applications.

Figure 7:
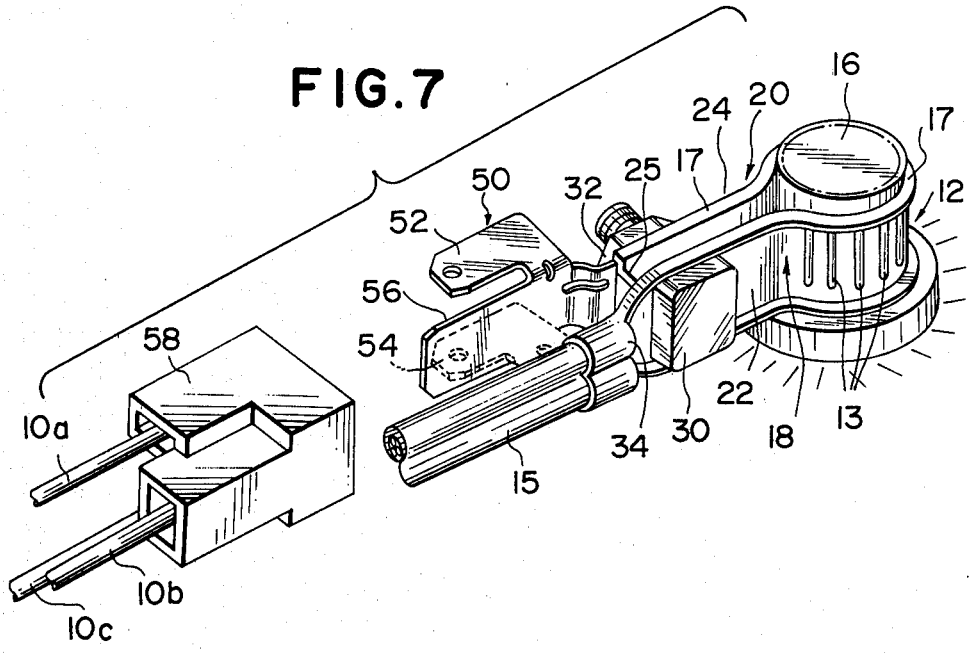
FIG. 7 is a perspective view, similar to FIG. 4, showing a third embodiment of the battery terminal connecting device according to the present invention.
Figure 8:
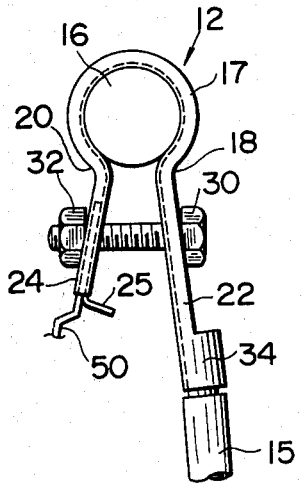
FIG. 8 is a plan view, similar to FIGS. 2 and 3, of this third embodiment of the battery terminal device according to the present invention.

FIG. 7 shows an important third embodiment of the present invention. This embodiment is similar to the embodiment shown in FIG. 4 (the first embodiment), and, therefore, like parts in the relevant figures are denoted by like reference numerals. This battery terminal connecting device 12 has a connecting portion 14, again, formed with a number of grooves 13 on its inside which correspond to raised ribs on its outside surface. The essential feature of this third embodiment is that, on the portion of the extension 24 near to the hole for the bolt 30, there is provided an inwardly bent projection or tongue 25. This tongue 25 has a free edge which opposes the extension 22, and, when the nut 32 is tightened on the bolt 30, this edge of the tongue 25 eventually comes into contact with the extension 22, stopping the same from moving any further towards the extension 24; in other words, the tongue 25 prevents movement of the extensions 22 and 24 closer to one another than a certain predetermined minimum distance. Thus the tongue 25 acts as a stopper and defines the useful tightening limit of the bolt 30. The function of this tongue is, to restrict the possible amount of elastic deformation of the portions of the extensions 22 and 24 between the bolt 30 and the gripping portion 14 by acting as a fulcrum around which the extensions 22 and 24 must bend in order for the gripping portion to be tightened further. It has a particular meaning with regard to the essential feature of the present invention that is, because the contact area of the inner surface of the gripping portion 14 is much smaller than is the case in the prior art, if the pressure between this reduced contact surface and the battery terminal post 16 becomes unduly great, there is a danger that the surface of the battery terminal post 16, which typically is made of a soft substance, such as lead, may become damaged and deformed. This may especially happen if the bolt and nut 30 and 32 are tightened unduly. However, this danger, introduced by the uneven configuration of the interior surface of the gripping portion 14, is effectively precluded by the provision of this projection 25, so as to, as above explained, limit the squeezing together of the projections 22 and 24.

Figure 9:
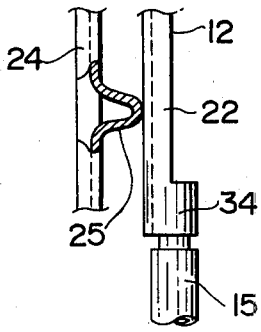
FIG. 9 is a part sectional view of part of a fourth embodiment of the present invention, taken along a plane parallel to the plane of the paper in FIG. 8.

As a fourth embodiment of the present invention, such as projection may be modified, as shown in FIG. 9, to be a fold in the material of the extension 24. This arrangement is stronger than that of the third embodiment. Other possible forms of the projection may be easily imagined by one skilled in the art, based upon the above disclosure.

Although the present invention has been shown and described in terms of some preferred embodiments thereof, and in language more or less specific with regard to structural features thereof, and with reference to the illustrative drawings, it should be understood that in any particular embodiment of the present invention various changes, modifications, and omissions of the form and the detail thereof can be made by a person skilled in the art, without departing from the essential scope of the invention. Therefore, it is expressly desired that the scope of the present invention should be uniquely delimited by the legitimate and valid scope of the appended claims, which follow, and not by any of the perhaps purely fortuitous details of the shown embodiments, or of the drawings.

What is claimed is:

1. A battery terminal connecting device, for connecting a battery terminal to an electric cable, comprising:

a gripping portion formed of elastically deformable and electrically conductive material in the shape of a hollow shell having an axially extending slot formed therein to permit the shell to open and close;

a pair of extensions from the gripping portion, each extension extending outwardly from one side of the slot, which extensions extend generally in the same direction, and to one of which extensions the cable is coupled, one of said extensions being formed with a protruding portion which projects towards the other extension and which elastically prevents the extensions from approaching closer than a predetermined distance by acting as a fulcrum around which said extensions must bend in order for said gripping portion to be further tightened after said extensions approach said predetermined distance;

a means for biasing the extensions towards one another; and a plurality of high portions and low portions formed on the inner surface of said gripping portion, the low portions of which interrupt contact between the inner surface of said gripping portion and the battery terminal so that said inner surface of said gripping portion is constricted onto the periphery of said battery terminal with a contact area substantially less than the total area of the inner surface when said gripping portion is disposed around the battery terminal and closely contacted therewith by the extensions being biased towards one another by the biasing means thereby deforming the gripping portion.

2. A battery terminal connecting devices according to claim 1, wherein said projection from said one extension is a bent over portion of said extension with a free edge which confronts the other extension.

3. A battery terminal connecting device according to claim 1, wherein said projection from said one extension is attached to a major portion of said one extension and has an end section opposed to the other extension, said projection being elastic to resist a force biasing said extension together.

4. A battery terminal connecting device according to claim 1, wherein said gripping portion and said extensions are provided with flanges which extend along the edges thereof perpendicular to their surfaces.

5. A battery terminal connecting device according to claim 1, wherein one of said extensions is provided with an auxiliary terminal having a plurality of connecting legs each of which is connectable to a separate cable.

6. A battery terminal connecting device according to claim 1, wherein said high portions and said low portions formed on said inner surface of said gripping portion are elongated and extend axially along said surface.

7. A battery terminal connecting device according to claim 6, wherein said high portions and said low portions form raised ribs on the outer surface of said gripping portion, said ribs corresponding to said low portions.

8. A battery terminal connecting device according to claim 6, wherein said high portions and said low portions form raised ribs on the inner surface of said gripping portion, said raised ribs corresponding to the high portions.

9. A battery terminal connecting device according to any one of claims 1, 6, 7 or 8 inclusive, wherein said high portions and said low portions are formed on said gripping portion at regular intervals by press forming.

10. A battery connector for an automotive vehicle battery comprising:

a substantially cylindrical grip portion adapted to grip a conical battery terminal, said grip portion being provided with a plurality of ribs extending in substantially vertical direction, which grip portion has ends opposing each other and defining a space therebetween;

a pair of first and second extensions extending respectively from said ends of said grip portion in substantially parallel relationship with respect to one another, one of said extensions being formed with a protruding portion which projects towards the other extension and which elastically prevents the extensions from approaching closer than a predetermined distance by acting as a fulcrum around which said extensions must bend in order for said gripping portion to be further tightened after said extensions approach said predetermined distance, said first extension being connected to a cable; and an auxiliary terminal provided at the free end of said second extension, said auxiliary terminal having a plurality of separate leg sections respectively adapted to be connected with auxiliary cables.

11. A battery connector for an automotive vehicle battery comprising:

a substantially cylindrical grip portion adapted to elastically grip a conical battery terminal, said grip portion being provided with a plurality of inwardly protruding ribs extending vertically and in parallel to one another, said grip portion having end sections respectively separated in spaced relationship for permitting elastic engagement between said battery terminal and said grip portion;

a pair of first and second extensions extending from said ends of said grip portion substantially parallel to each other;

a means for biasing said first and second extensions toward each other to reduce the diameter of said grip portion for elastic engagement between said battery terminal and said grip portion; and a means for limiting the relative motion of said first and second extensions toward each other by acting as a fulcrum about which said extensions must bend in order to approach closer than a predetermined distance, said relative motion limiting means having elasticity for resisting the biasing force applied by said biasing means.

12. A battery connector for an automotive vehicle battery comprising:

a substantially cylindrical grip portion adapted to elastically grip a conical battery terminal, said grip portion having inwardly protruded ribs extending in a vertical direction and arranged in parallel relationship with respect to each other, said grip portion having end sections separated from each other for permitting an elastic engagement between said grip portion and said battery terminal;

a pair of first and second extensions respectively extending from said end portions of said grip portion in parallel relationship with respect to one another, said first extension being connected with a cable attached to vehicle devices;

an auxiliary terminal provided at a free end of said second extension and having a plurality of separated connecting terminals respectively connectable with auxiliary cables;

a first means for biasing said first and second extensions to each other to reduce the diameter of said grip portion for elastic engagement between said grip portion and said battery terminal; and a second means for limiting the relative motion of said first and second extensions toward each other, by acting as a fulcrum around which said extensions must bend in order to approach closer than a predetermined distance, said second means having elasticity for resisting the biasing force when the dimension between said first and second extensions becomes smaller than of said predetermined distance.

* * * * *